US007483810B2

(12) United States Patent
Jackson et al.

(10) Patent No.: US 7,483,810 B2
(45) Date of Patent: Jan. 27, 2009

(54) REAL TIME EVENT LOGGING SYSTEM

(75) Inventors: Louis R. Jackson, Peoria, AZ (US); Randy W. Hostettler, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/880,826

(22) Filed: Jun. 29, 2004

(65) Prior Publication Data

US 2005/0288903 A1 Dec. 29, 2005

(51) Int. Cl.
*G04F 1/00* (2006.01)

(52) U.S. Cl. ..... 702/176; 702/177; 702/178; 709/219; 714/37; 714/39; 714/47; 379/90.01

(58) Field of Classification Search ..... 702/176–178; 714/47, 37, 39; 709/217; 370/90.01
See application file for complete search history.

(56) References Cited

U.S. PATENT DOCUMENTS 5,311,197 A 5/1994 Sorden et al.
6,092,008 A 7/2000 Bateman
6,293,501 B1 * 9/2001 Kurland ..... 244/164
2002/0126632 A1 9/2002 Terranova
2004/0078723 A1 * 4/2004 Gross et al. ..... 714/47
2004/0205151 A1 * 10/2004 Sprigg et al. ..... 709/217

FOREIGN PATENT DOCUMENTS

WO WO03/074326 A1 9/2003

OTHER PUBLICATIONS

Harrison, Richard A., ESA Solar Orbiter Remote Sensing Payload Working Group, Jun. 1, 2003.*
DeMar, John S, "Universal Flight Controller/Datalogger with Model Rocketry Applications," Aug. 1993, pp. 1-19.*
PCT International Search Report: PCT/US2005/022950, Applicant Reference No. H0005127-5710, Oct. 21, 2005, EP International Search Authority, 7 pages.

* cited by examiner

*Primary Examiner*—Tung S Lau
*Assistant Examiner*—Sujoy K Kundu
(74) *Attorney, Agent, or Firm*—Ingrassia Fisher & Lorenz, P.C.

(57) ABSTRACT

A method for monitoring a system operating in real-time includes monitoring the system for a triggering event or events, recording data about the system to a first memory in real time prior to and/or for a set time subsequent to when the triggering event occurs, and sending the stored data from the first memory to a second memory or an interface for retrieval.

24 Claims, 8 Drawing Sheets

REAL TIME EVENT LOGGING SYSTEM

TECHNICAL FIELD

This invention relates to the field of diagnostic data gathering and more particularly to a real time event logging system.

BACKGROUND

The ability to record system parameters during the real time operation of a device is important. However, the ability to monitor these devices is limited for several reasons. First, since the device is operating in real time if the device is stopped to allow for measurements of parameters, these measurements are no longer being done to a device operator in real time. Additionally, the device may have limited ability to report data, making it impossible to provide an indication of device parameters when executing certain operations. For example, a satellite may include control momentum gyroscopes (CMGs) for attitude control. Due to the limited telemetry and bandwidth available to the satellite, the ability to record event data concerning an anomalous event often can not be done in real time.

Additionally, when developing software to run on real time controllers, such as those that control the control momentum gyroscopes, it is impossible to stop and gather data because stopping to gather data stops the real time process. Furthermore, stopping the device may represent a tremendous burden to the system in which the device is integrated.

Accordingly, it is desirable to provide a real time event logging system that allows data regarding anomalous behavior to be stored in real time and sent later for analysis. Other desirable features and characteristics of the present invention will become apparent from the subsequent detailed description and the appended claims, taken in conjunction with the accompanying drawings and the foregoing technical field and background.

BRIEF SUMMARY

In one embodiment of the present invention, a method for monitoring a system operating in real-time is disclosed. The method includes monitoring the system for a triggering event, recording data about the system to a first memory in real time for a set time when the triggering event occurs, and sending the stored data from the first memory to a second memory or an interface for retrieval.

In another embodiment, an event monitor for a system operating in real-time is disclosed. The monitor includes one or more sensors operable to monitor one or more parameters of the system. A processor, coupled to the one or more sensors is provided. The processor is operable to receive data from the one or more sensors or software parameters and initiate the storage of monitored data comprising at least part of the data from the one or more sensors or software parameters upon the occurrence of a predefined event. A first memory stores the monitored data while the system is operating and a second memory or an interface receives the monitored data from the first memory at a selected time.

BRIEF DESCRIPTION OF THE DRAWINGS

The present invention will hereinafter be described in conjunction with the following drawing figures, wherein like numerals denote like elements, and.

DETAILED DESCRIPTION

Figure 1:
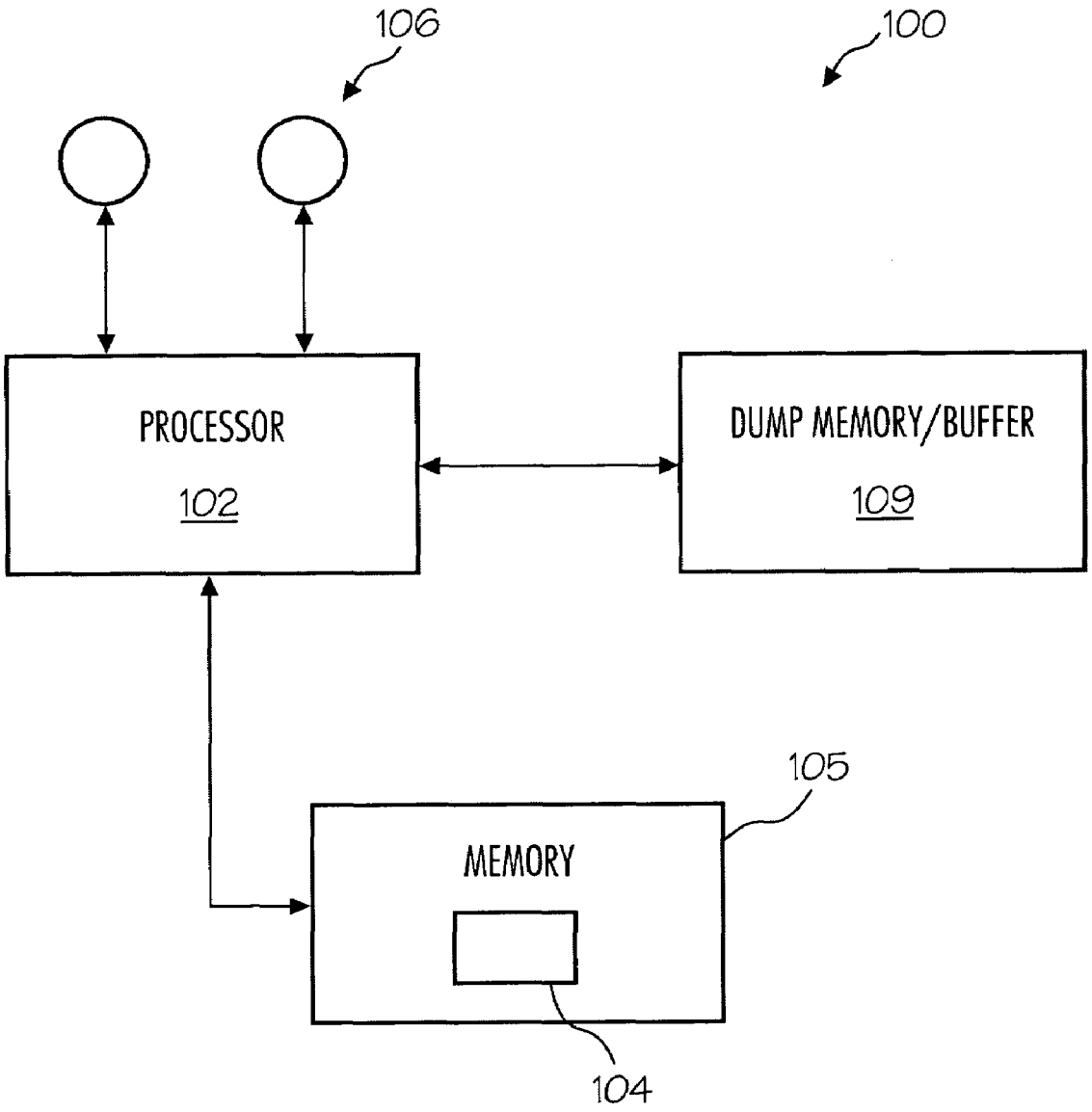
FIG. 1 is a block diagram illustrating the components of an embodiment of the present invention.

The following description discusses embodiments of the present invention as used in conjunction with CMGs, which are typically used for attitude control on spacecrafts such as satellites. However, the discussion of the use of the present invention with CMGs is for exemplary purposes only and the present invention can be used in varied and diverse applications where real time monitoring of events is required. The present invention provides a method and apparatus to record data concerning system parameters in real-time and allows for the transference of the data for analysis at a later time. Also, the present invention allows for the recording of data from an operating system without delaying, stopping or otherwise disturbing the operating system An exemplary real time monitoring system 100 is illustrated in FIG. 1. Real time monitoring system 100 monitors the parameters of one or more systems or internal software parameters while the system is operating. The monitoring system starts recording data or stops recording data upon the occurrence of a predetermined event, where an event may be comprised of one or more parameters achieving a certain state or states with respect to an event definition criteria. Provisions are made to start recording when an event occurs and to continue recording for a selectable amount of time afterwards, or to record continuously until an event occurs and then stop recording a selectable amount of time afterwards. For example, monitoring system 100 may monitor the temperature of a system component. When the component reaches a certain temperature, recording is triggered and one or more system parameters are recorded for later review. Thus, real time monitoring system 100, in one embodiment, is an event driven static machine that stops recording or starts recording upon the occurrence of an event. In one exemplary embodiment, real time monitoring system 100 comprises a monitoring processor 102 and monitoring memory 105.

Monitoring processor 102 runs software that receives commands from other systems and responds to the commands. Monitoring processor 102 can run software controlling the state of the monitoring system 100. Monitoring processor 102 can further receive inputs from one or more sensors 106. Sensors 106 are of conventional design and can be used to detect pressure, temperature, rate of rotation, momentum and the like. Monitoring processor 102 can be any conventional processor, embedded or otherwise.

Monitoring memory 105 stores programs and data used or created by the monitoring processor 102 to implement the present invention. Monitoring memory 105 also includes an Event Log Buffer 104 for storing data gathered when monitoring a system. In one embodiment, Event Log Buffer 104 is a circular (first in-first out) buffer memory. Further, in one embodiment, data is recorded to Event Log Buffer 104 as one or more records. The size of each record depends on what parameters are being monitored. Monitoring memory 105 is typically random access memory (RAM) although any suitable memory can be used. Monitoring memory 105 and Event Log Buffer 104 are shown as one component; however, they can be separate memory units as well.

Also provided is a dump memory 109. Dump memory 109 provides a memory space to store data transferred from real time monitoring system 100. Dump memory 109 is typically designed to be accessible even while real time monitoring system 100 is operating to monitor a device or system. In one embodiment, dump memory 109 can be an interface accessible from outside the system 100 via connection 111 to read data from the monitoring memory 105.

Figure 2:
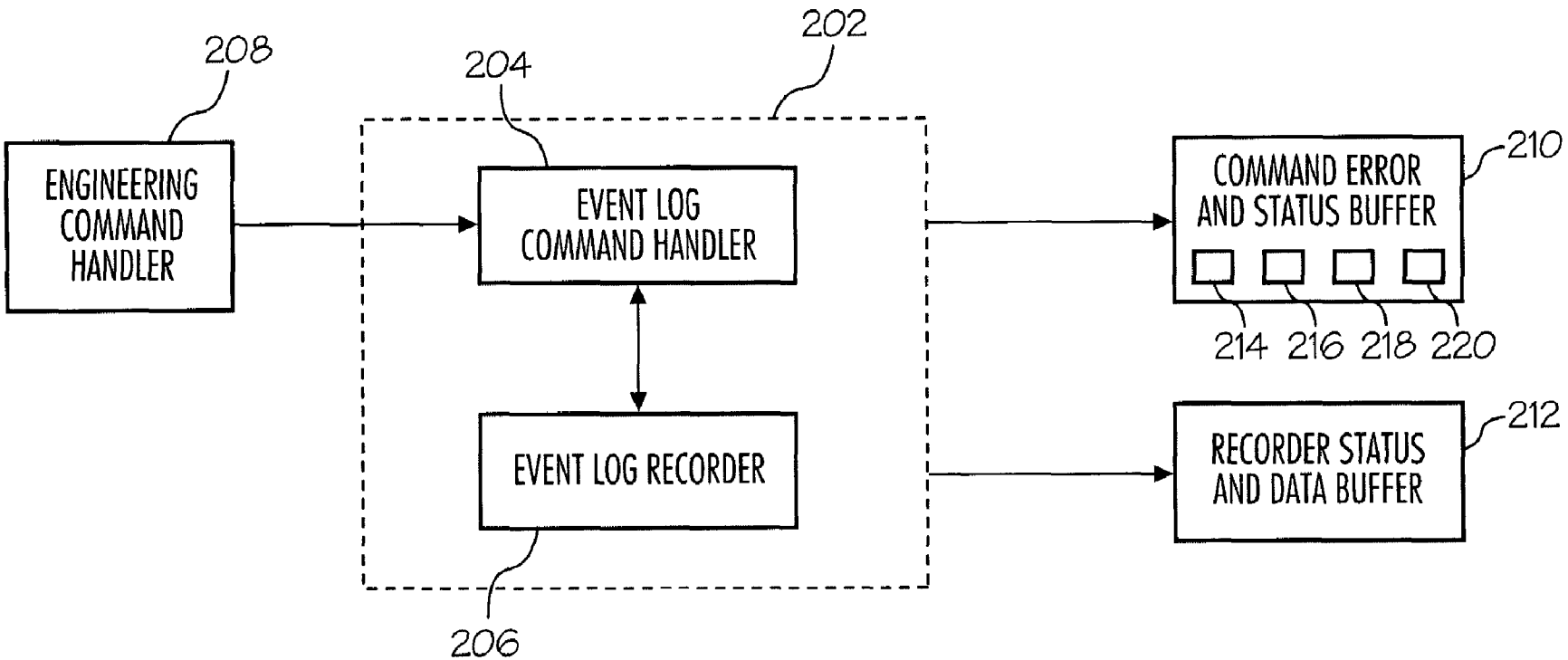
FIG. 2 is a block diagram of software components of an embodiment of the present invention.

An exemplary block diagram of the software executed by monitoring processor 102 as well as the software inputs into the software is illustrated in FIG. 2. This block diagram and the following discussions are one embodiment of the present invention and various changes to the activities performed by each part of the software, as well as any changes are within the scope of the teachings of the present invention. An Event Log Manager 202 in one embodiment, handles commands sent from a controller, such as those sent by Engineering Command Handler 208, as well as performs all processing related to the recording of events. Event Log Manager 202 comprises, in one embodiment, an Event Log Command Handler 204 and an Event Log Recorder 206.

Event Log Command Handler 204 is coupled to a Command Error and Status Buffer 210. Command Error and Status Buffer 210 stores information about the Event Log Command Handler 204 such as error flags or status flags. The flags can be retrieved by a user or subsystem. Event Log Recorder 206 is coupled to a Recorder Status and Data Buffer 212. Recorder Status and Data Buffer 212 stores data transferred (or dumped) from the Event Log Recorder 206. In one embodiment, Recorder Status and Data Buffer 212 is Dump Memory 109. Alternatively, Recorder Status and Data Buffer 212 can act as an interface for transmitting the contents of monitoring memory 105. In one embodiment, the Recorder Status and Data Buffer 212 can be part of dump memory 109. The transferred data includes data captured when monitoring parameters of a system. Also, information regarding the status of the Event Log Recorder 206 can be stored in the Recorder Status and Data Buffer 212.

Event Log Recorder 206 receives commands from the Event Log Command Handler 204 to control the capture of data. In one embodiment, Event Log Recorder 206 operates as a State machine. In a preferred embodiment, Event Log Recorder 206 has five operating states: Dumping, Idle, Armed, Triggered or Suspended.

The Event Log Command Handler 204 receives commands from the Engineering Command Handler 208 in order to control Event Log Recorder 206. Operation of the Event Log Recorder 206 is controlled by the Event Log Commands received by the Event Log Command Handler 204. The Event Log Command Handler 204 processes these commands to control the Event Log Recorder 206. The Event Log Command Handler 204, in one embodiment, supports the following commands: (1) Event Log Data Select, (2) Event Log Event Definition, (3) Event Log Start, (4) Event Log Suspend, (5) Event Log Resume, and (6) Event Log Dump. While these are supported commands in a preferred embodiment, different, additional or fewer commands can be supported within the scope of the present invention. The following discussion covers each command and the commands effect on the state of Event Log Recorder 206, in conjunction with FIGS. 3-6.

The Event Log Data Select Command 305 tells the Event Log Recorder 206 what data parameters to record and at what rate to record the data. In one embodiment, the Event Log Recorder 206 can record data at multiple different rates such as 512 Hz, 128 Hz, 32 Hz, and 8 Hz. Of course, any recording rate and combinations of recording rates can be chosen. In one exemplary embodiment, zero to eight different data parameters may be selected for recording with each data parameter recorded at any of the supported data rates. The data parameters can be data collected from any source such as sensors 106. Also, a record can be formed comprising the data stored in a fixed number of cycles. For example, in one embodiment, each record comprises the data recorded over an 8 Hz cycle, although other rates can be used. The Event Log Data Select Command 305 can specify the data parameters to be recorded as part of the command. Alternatively, the Event Data Select Command 305 can reference a table comprising a listing of data parameters to be recorded.

Figure 3:
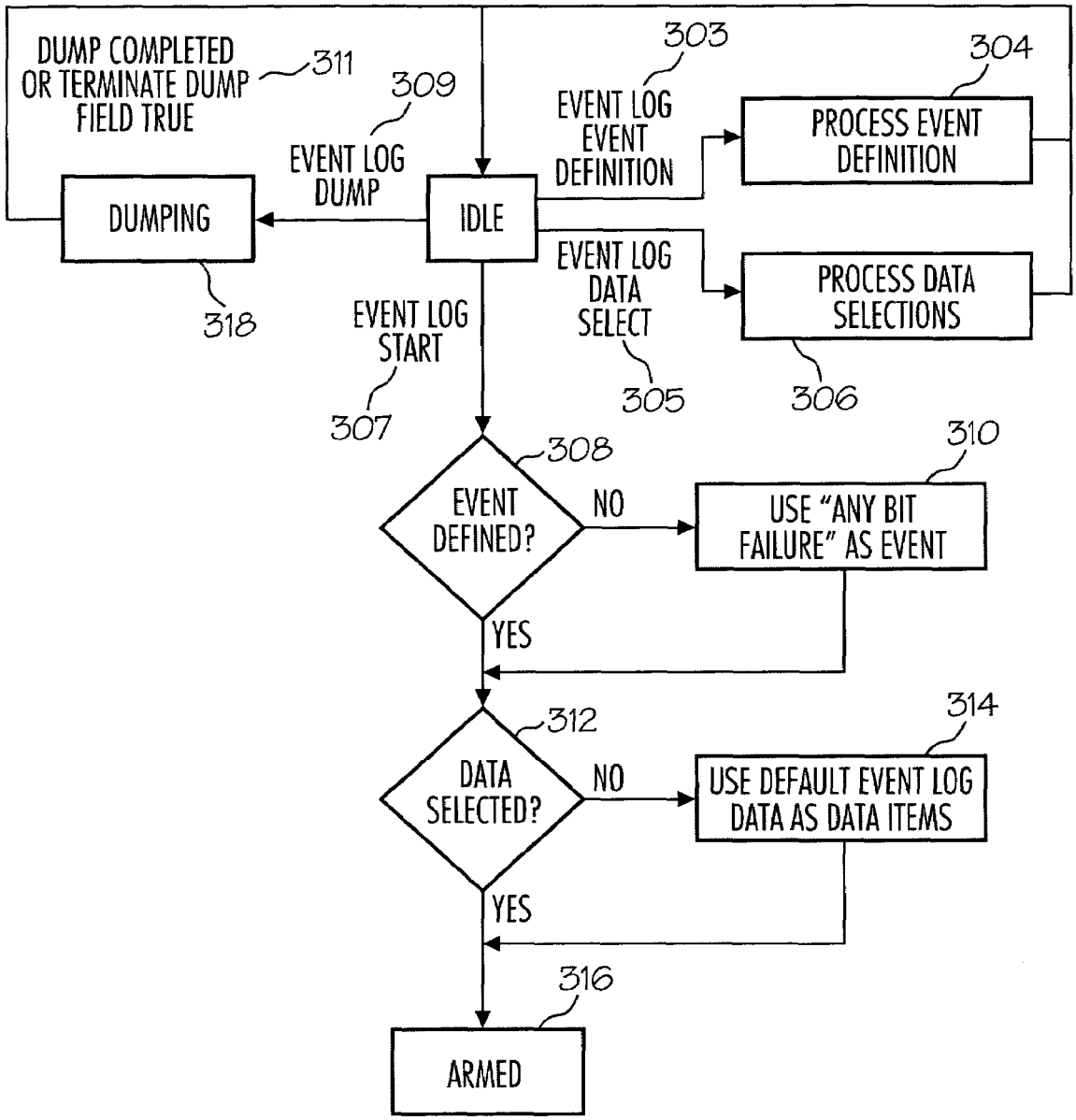
FIG. 3 is a process diagram for the Idle State of an embodiment of the present invention.
Figure 6:
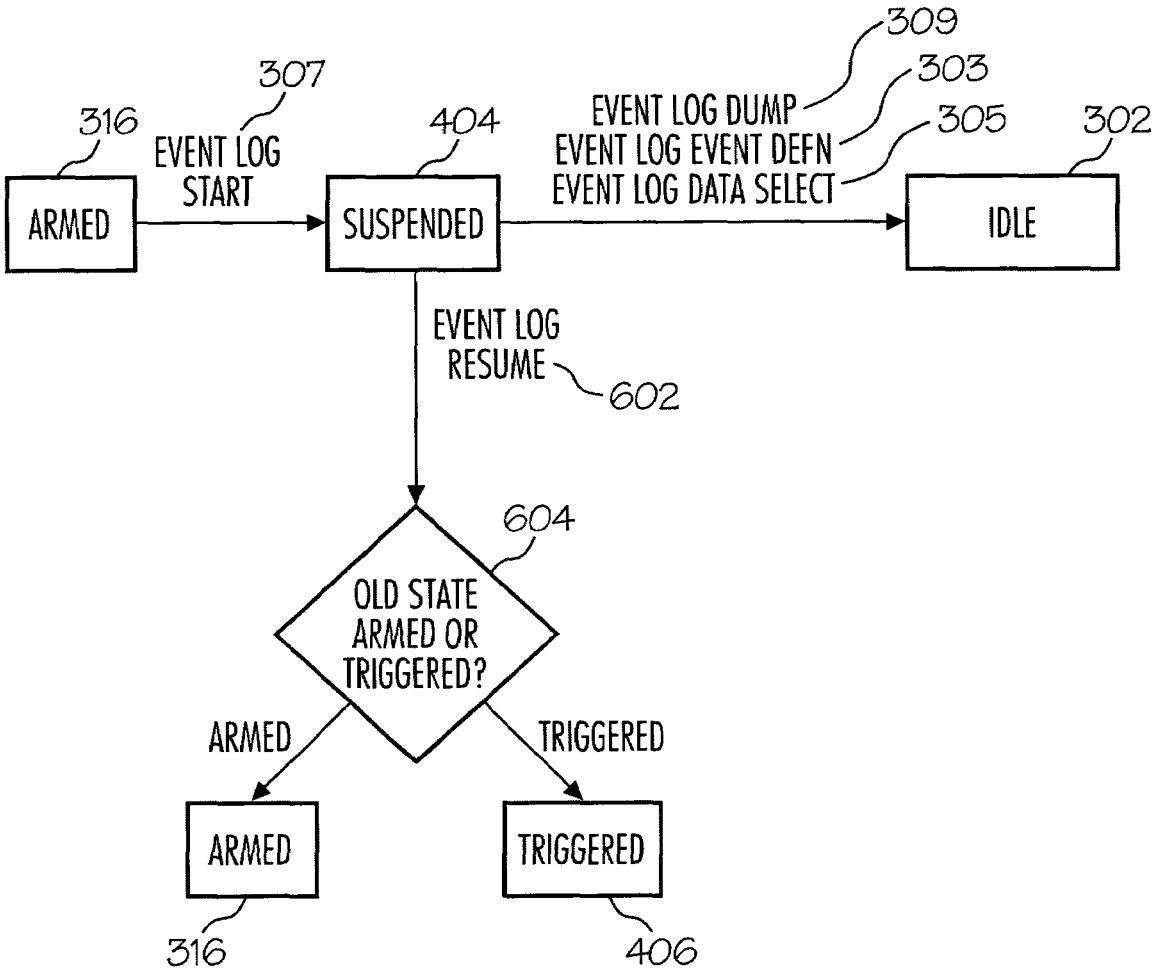
FIG. 6 is a process diagram for the Suspended State of an embodiment of the present invention.

The Event Log Data Select Command 305 can be received by the Event Log Recorder 206 when the Event Log Recorder 206 is in the Idle State 302 or the Suspended State 404. As seen in FIG. 3, when the Event Log Recorder 206 is in the Idle State 302 and receives the Event Log Data Select Command 305, the Event Log Recorder 206 can process the command and can then return to the Idle State 302. As seen in FIG. 6, when the Event Log Recorder 206 is in the Suspended State 404 and the Event Log Data Select Command 305 is received, the command can be processed and the Event Log Recorder 206 returns to the Idle State 302.

The Event Log Command Handler 204 can check for any hardware errors that might be encountered during reception of the Event Log Data Select Command 305. If any hardware errors are reported for the message, the Event Log Command Handler 204 reports the error to a Command Error and Status Buffer 210, and the Event Log Data Select Command 305 is not executed. The length of the Event Log Data Select Command 305 can vary depending on the number of data parameters to record listed in the command and, therefore the Event Log Command Handler 204 does not need to check the size of the Event Log Data Select Command 305.

When the Event Log Data Select Command 305 is received, the Event Log Buffer 104 can be initialized to an "empty" State. To prevent the inadvertent loss of data in the Event Log Buffer 104 when sending the Event Log Data Select Command 305, the Event Log Command Handler 204 can check the Command Error and Status Buffer 210 to determine if an "Event Log Event Occurred" (ELEO) flag 214 is set to true. If the ELEO flag is set to true, data is available (i.e., currently available in memory) in the Event Log Buffer 104. In one embodiment, in order to send an Event Log Data Select Command 305 when the ELEO flag 214 is set to true, the data in the Event Log Buffer 104 is ignored. This can be done by setting a "Clear Event Log Event Occurred" (CELEO) flag to true in the Event Log Data Select Command 305. If the ELEO flag is true, and the Event Log Data Select Command 305 is sent without the CELEO flag set to true, an "Event Log Command Error" (ELCE) flag 216 is set to true in the Command Error and Status Buffer 210, and the Event Log Data Select Command 305 is not executed.

Figure 4:
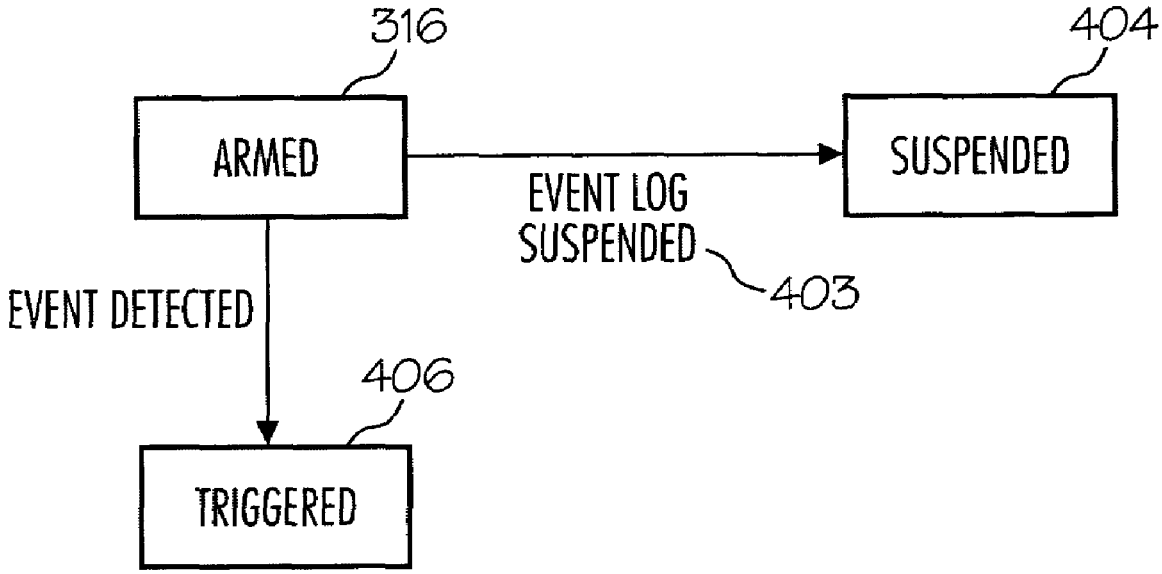
FIG. 4 is a process diagram for the Armed State of an embodiment of the present invention.

Similarly, when the Event Log Recorder 206 is logging data or dumping the contents of the Event Log Buffer 104, if the Event Log Data Select Command 305 is sent an Event Log Command Error can be generated. If the Event Log Recorder 206 is logging data, an "Event Logging in Progress" (ELIP)

flag 218 can be set to true in the Command Error and Status Buffer 210. If the contents of the Event Log Buffer 104 are being dumped, an "Event Log Dump in Progress" (ELDIP) flag 220 in the Command Error and Status Buffer 210 can be set to true. The recording of data by the Event Log Recorder 206 can be stopped by sending an Event Log Suspend Command 403, as seen in FIG. 4. Also, dumping of data from the Event Log Buffer 104 can be stopped by sending an Event Log Dump Command 309 with a "Terminate Event Log Dump" command bit set to true when the Event Log Recorder 206 is in the Idle State 302, as shown in FIG. 3.

The Event Log Event Definition Command 303 can be used to specify the one or more trigger conditions, or events, to which the Event Log Recorder 206 responds by starting or stopping the recording of one or more of the data parameters set by the Event Log Data Select Command. The Event Log Recorder 206 can be set through the Event Log Start Command 307 to record data either before or after the defined event or events are detected as will be discussed in greater detail below. The Event Log Event Definition Command 303 defines an event using multiple separate expressions that can be logically ANDed and/or ORed together. In an exemplary embodiment for 16-bit integer data (although this does not preclude other data sizes or data formats from being used), each expression can include one or more of the following components: the data parameter (such as the software parameters or sensor inputs) to examine, a 16-bit mask applied to the data read from an indicated location to allow removal of unwanted or non-applicable bits from the data word, a 16-bit value defining the limit or data pattern to be compared to the masked data item, a comparison method (equal, not equal, less than, greater than, or other desired comparison method) and an indication of whether the comparison is signed or unsigned, i.e., whether the most significant bit of the integer data should be interpreted as a sign bit or as another magnitude bit.

The Event Log Event Definition Command 303 can be received by the Event Log Recorder 206 when the Event Log Recorder 206 is in the Idle State 302 or the Suspended State 404. As seen in FIG. 3, when in the Idle State 302, the Event Log Recorder 206 can receive the Event Log Event Definition Command 303 and can process the command and return to the Idle State 302. As seen in FIG. 6, when the Event Log Recorder 206 is in the Suspended State 404 and the Event Log Event Definition Command 303 is received, the command can be processed and the Event Log Recorder 206 can return to the Idle State 302.

If the Event Log Event Definition Command 303 does not specify an event, or if no event log event definition command is received, a "default" event can be used. In one embodiment, the "default" event is defined as the reporting of any Built-In-Self-Test (BIT) failure detected by the processor software or system hardware. The Built-in-Self-Test can be any self-diagnostic check performed by the system 100.

The existence or occurrence of an event criteria, as defined by the Event Log Event Definition Command 303, can be checked for at regular intervals (or at irregular periods) when the Event Log Recorder 206 is in the Armed State 316. In one embodiment, the interval is a 512 Hz rate interval. Detection of the defined event results in the Event Log Recorder 206 transitioning to the Triggered State 406. The data that satisfied the event criteria can be logged in an Event Log Header of a data packet or frame that will be transferred with the collected data to Event Log Buffer 104 in order to provide a record of the triggering event. The Event Log Recorder 206 remains in the Triggered State 406 for a period of time controlled by the Event Log Start Command 307.

The Event Log Command Handler 204 can verify the length of the Event Log Event Definition Command 303 message and can check for any hardware errors encountered during reception of the message. If the number of words received for the command is incorrect (length of message is incorrect), or if any hardware errors were reported for the message, the Event Log Command Handler 204 reports the error to the Command Error and Status Buffer 210, and the Event Log Event Definition Command 303 is not executed.

Similar to the Event Log Data Select Command 305, when the Event Log Event Definition Command 303 is received, the Event Log Buffer 104 can be initialized to the "empty" State. To help prevent the inadvertent loss of data in the Event Log Buffer 104 when sending the Event Log Event Definition Command 303, the Event Log Command Handler 204 checks the Command Error and Status Buffer 210 to determine if the ELEO flag 214 is set to true. If the ELEO flag 214 is true, data is available in the Event Log Buffer 104. In order to send an Event Log Event Definition Command 303 in this case, the data in the Event Log Buffer 104 is ignored. This can be done by setting the CELEO flag that is part of the Event Log Event Definition Command 303 to true. If the ELEO flag 214 is true, and the Event Log Event Definition Command 303 is sent without the CELEO flag set to true, the ELCE flag 216 is set to true in the Command Error and Status Buffer 210, and the command will not be executed.

Similarly, when the Event Log Recorder 206 is either logging data or dumping the contents of the Event Log Buffer 104, if the Event Log Event Definition Command 303 is sent an Event Log Command Error can be generated. If the Event Log Recorder 206 is logging data, the ELIP flag 218 can be set to true in the Command Error and Status Buffer 210. If the contents of the Event Log Buffer 104 are being dumped, the ELDIP flag 220 can be set to true. The Event Log Recorder 206 can be stopped by sending an Event Log Suspend Command 403. Also, the Event Log Buffer 104 dump can be stopped by sending an Event Log Dump Command 309 with the "Terminate Event Log Dump" command bit 311 set to true when the Event Log Recorder 206 is in the Idle State 302 as shown in FIG. 3.

The Event Log Start Command 307 can be used to cause the Event Log Recorder 206 to clear the contents of the Event Log Buffer 104 and transition from the Idle State 302 to the Armed State 316. Prior to sending an Event Log Start Command 307, the data to be stored can be selected using the Event Log Data Select Command 305. Also, the event criteria that triggers recording are sent with the Event Log Event Definition Command 303. Upon receiving the Event Log Start Command 307, and with reference to FIG. 3, the Event Log Recorder 206 determines if the data parameters to record have been previously selected (step 312) and if the event to trigger the recording (step 308) has been defined. The Event Log Recorder 206 uses the last set of data parameters selected by the Event Log Data Select Command 305 and the prior event criteria defined by the Event Log Event Definition Command 303, even if they were both set for a prior session. If an event to trigger recording has not been selected since power up or other initialization, a default setting can be used. In one embodiment the default event can be any Built-in-Self-Test (BIT) failure 310 and the default data parameter can be a default data set 314.

After receiving the Event Log Buffer 104, the Event Log Recorder 206 transitions to the Armed State 316. The Event Log Recorder 206 can receive the Event Log Start Command 307 when in the Suspended State 404 or Idle State 302. The reception of the Event Log Start Command 307 when the Event Log Recorder 206 is in the Suspended State 404 also places the Event Log Recorder 206 in to the Armed State 316 as seen in FIG. 6.

The Event Log Start Command 307, in one embodiment, can be set to one of two modes; a "Stop on Event" mode or a "Start on Event" mode. In the "Stop on Event" mode, the Event Log Recorder 206 continuously records data while in the Armed State 316 using the Event Log Buffer 104 as a circular queue of fixed sized records, overwriting the oldest data first. When a defined event is detected, the Event Log Recorder 206 transitions to the Triggered State 406. The recording of data stops after a specified time period after entering the Triggered State 406. This time period can be set as part of the Event Log Start Command 307. In the "Start on Event" mode, the Event Log Recorder 206 either continuously records data within the same area of the buffer or does not record data at all while in the Armed State 316. When a defined event is detected, the Event Log Recorder 206 transitions to the Triggered State 406, adding new records to the memory as new data is recorded. The recording stops after a specified time period as set by the Event Log Start Command 307 or when the Event Log Buffer 104 is full.

The Event Log Start Command 307 specifies how long to wait before recording data in the Triggered State 406 and for how long to record data in the Triggered State 406. In one embodiment, the recording times and recording mode can be set by the following fields and flags in the Event Log Start Command 307: Record from Start Time flag, Record Mode field, Record Time field, and Start Delay Time field.

The amount of time the Event Log Recorder 206 waits in the Triggered State 406 before recording data depends on the Record Mode field and Start Delay Time field. If the Record Mode is "Stop on Event", the Event Log Recorder 206 does not wait before initiating recording of data, since the Event Log Recorder 206 has been recording data since receiving the Event Log Start Command 307. If the mode is "Start on Event", the Event Log Recorder 206 waits the amount of time specified in the Start Delay Time field before starting to record data.

The length of time data is recorded is based on the Record Mode, Record from Start Time flag, and Record Time fields in the Event Log Start Command 307. In the "Stop on Event" mode of operation, the Event Log Recorder 206 records data for the time indicated in the Record Time field, and then stops. In the "Start on Event" mode, the Event Log Recorder 206 will record data for a period of time depending on the value of a Record from Start Time flag. If the Record from Start Time flag is set to false, the Event Log Recorder 206 records data for as long as the event criteria are met, or until the Event Log Buffer 104 is full. Once the conditions that meet the event criteria are no longer present, the Event Log Recorder 206 continues to record data for the time indicated in the Record Time field. However, if the Record from Start Time flag is set to true, the Event Log Recorder 206 records data for the time indicated in the Record Time field and then stops, regardless of the current state of the defined event.

Figure 5:
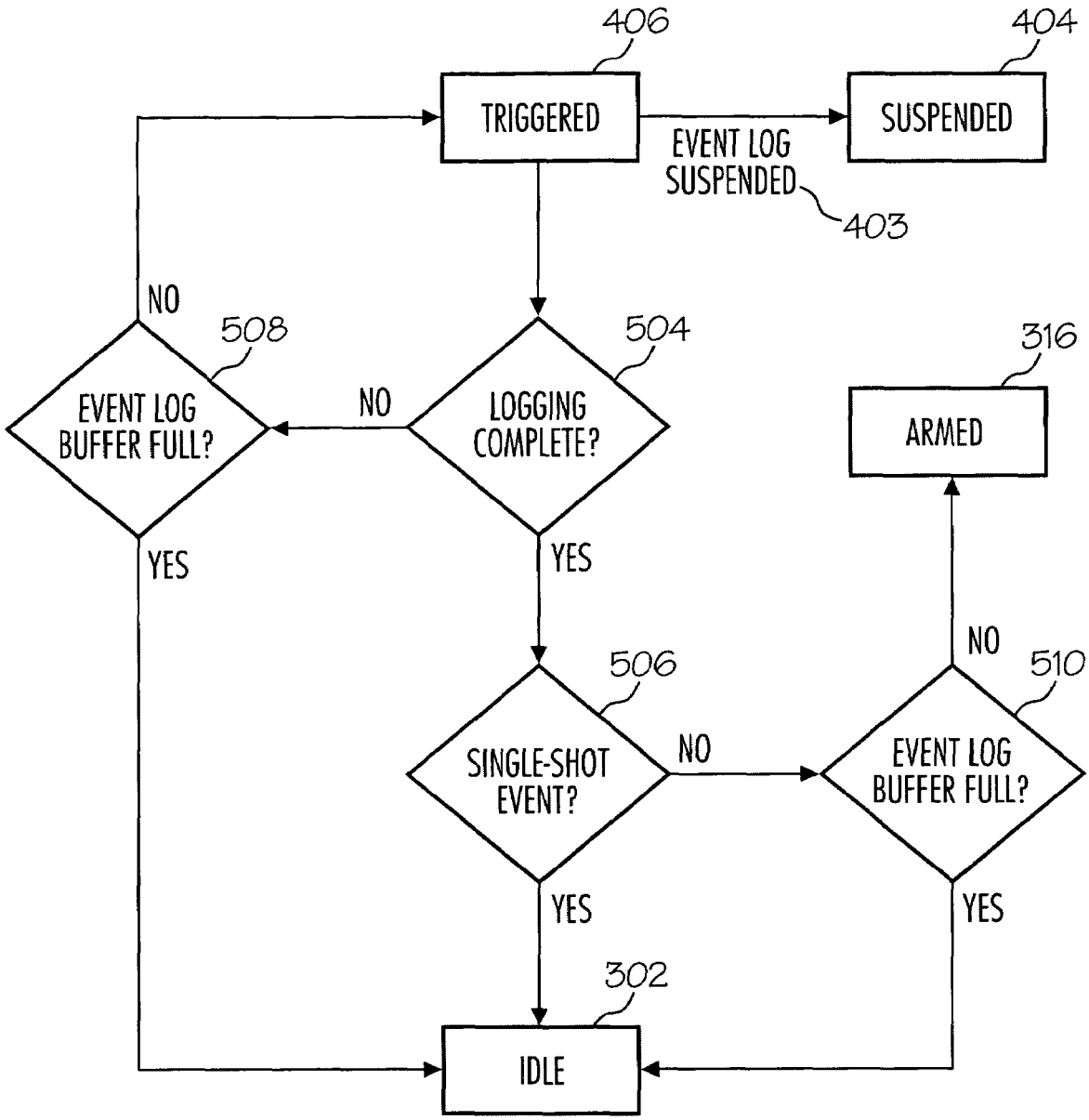
FIG. 5 is a process diagram for the Triggered State of an embodiment of the present invention.

The Event Log Start Command 307 can also include a multiple event counter field. The multiple event counter field sets the number of separate triggering events that can be recorded to the buffer. If the multiple event counter is set to zero, the triggering event is a single shot event and after data for that event is recorded, the Event Log Recorder 206 enters the Idle State 302 as seen in FIG. 5. If the multiple event counter field is greater than zero, the Event Log Recorder 206 will enter the Armed State 316 each time a data recording is complete, up to the limit of the multiple event counter. When that limit is reached, the Event Log Recorder 206 returns to the Idle State 302. When the Event Log Buffer 104 is filled, the Event Log Recorder 206 will return to the Idle State 302, whether or not all events have been recorded.

Referring to FIG. 5, once the Event Log Recorder 206 is in the Triggered State 406, the Event Log Recorder 206 can check to determine if logging is complete (step 504). If logging is complete, then it is determined if the Event Log Buffer 104 is full (step 508). If the Event Log Buffer 104 is not full and logging is not complete, the Event Log Recorder 206 stays in the Triggered State 406. If logging is complete, it is determined if the there was a single shot event (step 506). If the event was a single shot event, the Event Log Buffer 104 transitions to the Idle State 302. If the event was not a single shot event, it is determined if the Event Log Buffer 104 is full (step 510). If the Event Log Buffer 104 is full, the Event Log Recorder 206 transitions to the Idle State 302. If the Event Log Buffer 104 is not full, the Event Log Recorder 206 transitions to the Armed State 316 to await further events.

The Event Log Command Handler 204 can verify the length of the Event Log Start Command 307 message and can check for any hardware errors encountered during reception of the message. If the number of words received for the command is incorrect, or if any hardware errors were reported for the message, the Event Log Command Handler 204 can report the error in the Command Error and Status Buffer 210, and the command is not executed.

When the Event Log Start Command 307 is received, the Event Log Buffer 104 is initialized to an "empty" State. To prevent the inadvertent loss of data in the Event Log Buffer 104 when sending the Event Log Start Command 307, the Event Log Command Handler 204 checks the Command Error and Status Buffer 210 to determine if the ELEO flag 214 is set to true. If an ELEO flag 214 is set to true, data is available in the Event Log Buffer 104. In order to send an Event Log Start Command 307 when the ELEO flag 214 is true, the data in the Event Log Buffer 104 is ignored. This can be done by setting the CELEO flag in the Event Log Start Command 307 to true. If the ELEO flag 214 is true, and the Event Log Start Command 307 is sent without the CELEO flag set to true, the ELCE flag 216 is set to true in the Command Error and Status Buffer 210, and the command will not be executed.

Similarly, if the Event Log Manager 202 is either logging data or dumping the contents of the Event Log Buffer 104, if the Event Log Start Command 307 is sent an Event Log Command Error can be generated. If the Event Log Recorder 206 is logging data, the ELIP flag 218 will be set to true in the Command Error and Status Buffer 210. If the contents of the Event Log Buffer 104 are being dumped, the ELDIP flag 220 is set to true. The Event Log Recorder 206 can be stopped by sending an Event Log Suspend Command 403. Also, the Event Log Buffer 104 dump can be stopped by sending an Event Log Dump Command 309 with the "Terminate Event Log Dump" command bit 311 set to true.

The Event Log Suspend Command 403 is used to stop the Event Log Recorder 206 when it is in the Armed State 316 (FIG. 4) or Triggered State 406 (FIG. 5). Upon reception of an Event Log Suspend Command 403, if the Event Log Recorder 206 is recording data in the Armed State 316 or Triggered State 406, the Event Log Recorder 206 can finish recording data for the current record and then transition to the Suspended State 404. If the Event Log Recorder 206 is in the Idle State 302 or already in the Suspended State 404, the Event Log Command Handler 204 ignores the Event Log Suspend Command 403.

As seen in FIG. 6, once the Event Log Recorder 206 is in the Suspended State 404, there are several options: (1) dump the current content of the Event Log Buffer 104 and then transition to the Idle State 302, (2) allow the Event Log Recorder 206 to return to the Armed State 316 or Triggered State 406, (3) redefine the event trigger or the selected data and transition to the Idle State 302, and (4) restart the Event Log Recorder 206 with the currently defined event trigger and selected data and transition to the Armed State 316.

If the Event Log Recorder 206 is in the Suspended State 404 and an Event Log Dump Command 309 is received, the Event Log Recorder 206 transitions to the Idle State 302, as seen in FIG. 6, and the Event Log Buffer 104 will begin to dump its contents, as seen in FIG. 3.

If the Event Log Recorder 206 is in the Suspended State 404 and an Event Log Resume Command 602 is sent, the Event Log Recorder 206 synchronizes to the start of the next record or frame and then returns to the state it was in when it was Suspended State 404, either Armed State 316 or Triggered State 406. When in the Suspended State 404, timers for the Event Log Recorder 206 continue to increment in real time. Thus, if the Event Log Recorder 206 returns to the Triggered State 406 after an Event Log Resume Command 602 is received, the time that the Event Log Recorder 206 was supposed to be recording data in the Triggered State 406 may have already elapsed, and the Event Log Recorder 206 may then immediately transition from the Triggered State 406. In one embodiment, during the Suspended State 404, the event criteria defined with the Event Log Event Definition Command 303 are not checked, so the Event Log Recorder 206 can "miss" a triggering event that occurs when the Event Log Recorder 206 was in the Suspended State 404. Once the Event Log Recorder 206 returns to the Armed State 316 or Triggered State 406 after receiving an Event Log Resume Command 602, the Event Log Recorder 206 resumes checking for the defined event.

The Event Log Command Handler 204 verifies the length of the Event Log Suspend Command 403 message and checks for any hardware errors encountered during reception of the message. If the number of words received for the command is incorrect, or if any hardware errors were reported for the message, the Event Log Command Handler 204 reports the error in the Command Error and Status Buffer 210, and the Event Log Suspend Command 403 is not executed.

If the Event Log Manager 202 is currently in the process of dumping the contents of the Event Log Buffer 104, if the Event Log Suspend Command 403 is sent an Event Log Command Error will be generated. If the Event Log Recorder 206 is dumping its contents, the ELDIP flag 220 can be set to true. The Event Log Buffer 104 dump can be aborted by sending an Event Log Dump Command 309 with the Terminate Event Log Dump Command bit 311 set to true.

The Event Log Resume Command 602 returns the Event Log Recorder 206 from the Suspended State 404 to either the Armed State 316 or Triggered State 406 as seen in FIG. 6. Upon reception of an Event Log Resume Command 602, the Event Log Recorder 206 can, in one embodiment, synchronize to the start of the next frame or record before resuming the Suspended State 404 in order to avoid partial records. The Event Log Recorder 206 uses the event triggers, selected data parameters, and recording modes previously defined when the Event Log Recorder 206 returns to the Armed State 316 or Triggered State 406. Data recorded in the Event Log Buffer 104 prior to the Event Log Recorder 206 entering the Suspended State 404 is retained.

If the Event Log Recorder 206 is not in the Suspended State 404, sending the Event Log Resume Command 602 can generate an error. The Event Log Command Handler 204 will set the Event Log Command Error (ELCE) flag 216 to true in the Command Error and Status Buffer 210, and the command will not be executed.

The Event Log Command Handler 204 verifies the length of the Event Log Resume Command 602 message and checks for any hardware errors encountered during reception of the message. If the number of words received for the command is incorrect, or if any hardware errors were reported for the message, the Event Log Command Handler 204 reports the error in the Command Error and Status Buffer 210, and the Event Log Resume Command 602 is not executed.

When the Event Log Manager 202 is dumping the contents of the Event Log Buffer 104, if the Event Log Resume Command 602 is sent an Event Log Command Error will be generated. If the Event Log Recorder 206 is dumping the Event Log Buffer 104 the "Event Log Dump in Progress" (ELDIP) flag 220 will be set to true. The Event Log Buffer 104 dump can be aborted by sending the Event Log Dump Command 309 with the Terminate Event Log Dump Command bit 311 set to true.

The Event Log Dump Command 309 starts or terminates dumping of the data in the Event Log Buffer 104 depending on the state of the Terminate Event Log Command bit 311. When dumping data, the data in the Event Log Buffer 104 can transmit to the Recorder Status and Data Buffer 212, which can exist as part of a dump memory 109 or to an interface. The Event Log Recorder 206 can receive the Event Log Dump Command 309 when in the Idle State 302 (FIG. 3) or Suspended State 404 (FIG. 6).

In one exemplary embodiment, upon reception of an Event Log Dump Command 309 (with the Terminate Event Log Dump Command bit 311 set to false) the Event Log Recorder 206 can begin placing data from the Event Log Buffer 104 into the Recorder Status and Data Buffer 212 (which can exist as part of dump memory 109), which typically requires a data bus transmit buffer, which could not be shown, until the entire Event Log Buffer 104 has been dumped. The requester (the system receiving the dumped data) can request the data as slowly as desired, as, in a typically embodiment, no new data can be placed into the Recorder Status and Data Buffer 212 until the data that is currently in the Event Log Buffer 104 is sent. In one exemplary embodiment, data can be transferred at 32 words at a time. In an alternative embodiment, the data from the Event Log Buffer 104 can be transferred to an interface connecting the system 100 to an external data collection device or system instead of dump memory 109.

In one embodiment, an Event Log Dump Header Record can be stored in the Recorder Status and Data Buffer 212 (which, as discussed before, can be part of dump memory 109). The Event Log Dump Header Record contains information about the Event Log Buffer 104 data. Information in the Event Log Dump Header Record can include: (1) size of the record, number of records, and the number of messages needed to transmit the entire Event Log Buffer 104; (2) time stamp of when the Event Log Recorder 206 was armed; (3) time stamp indicating when the event criteria was met; (4) table index and offset values for selected data; (5) an echo of the Event Log Start Command 307; and (6) an echo of the Event Log Definition Command 303.

In one embodiment, when an Event Log Dump is requested the Event Log Dump Header Record is the first data sent. Using the information in this record, the remaining data in the Event Log Buffer 104 can be decoded. Each data transfer (packet) sent can also include a sequence number so proper packet order can be determined in the event the packets are received out of sequence.

An Event Log Dump can be stopped by sending an Event Log Dump Command 309 with the Terminate Event Log Dump Command bit 311 set to true. This will cancel the Event Log dump in progress and reset the ELDIP flag 218 in the Command Error and Status Buffer 210 to false. Once a dump has been terminated, another dump may be started from the beginning by sending another Event Log Dump Command 309.

In one embodiment, other event log commands will not be processed while a dump is in progress. This is to help preclude inadvertent corruption of the Event Log data before the entire Event Log buffer has been dumped. If an Event Log Dump Command 309 is sent to initiate a dump (Terminate Event Log Dump Command bit 311 set to false) when a dump is already in progress, the command is ignored.

The Event Log Command Handler 204 verifies the length of the Event Log Dump Command 309 message and checks for any hardware errors encountered during reception of the message. If the number of words received for the command is incorrect, or if any hardware errors were reported for the message, the Event Log Command Handler 204 reports the error in the Command Error and Status Buffer 210, and the Event Log Dump Command 309 is not executed.

If the Event Log Recorder 206 is currently in the Armed State 316 or Triggered State 406 and the Event Log Dump Command 309 is sent, an Event Log Command Error will be generated. If the Event Log Recorder 206 is in the Armed State 316 or the Triggered State 406 the "Event Log Armed" (ELA) flag or the ELIP flag 218 will be set to true. Prior to sending an Event Log Dump Command 309 the Event Log Recorder 206 should be in the Idle State 302. If the Event Log Recorder 206 is in the Suspended State 404, the Event Log Recorder 206 can receive the Event Log Dump Command 309 but, in a typical embodiment, will transition to the Idle State 302 to execute the Event Log Dump Command 309. If the Event Log Recorder 206 is not in the Idle State 302 or Suspended State 404, the Event Log Recorder 206 can be placed in the Suspended State 404 and then sent the Event Log Dump Command 309.

Figure 7:
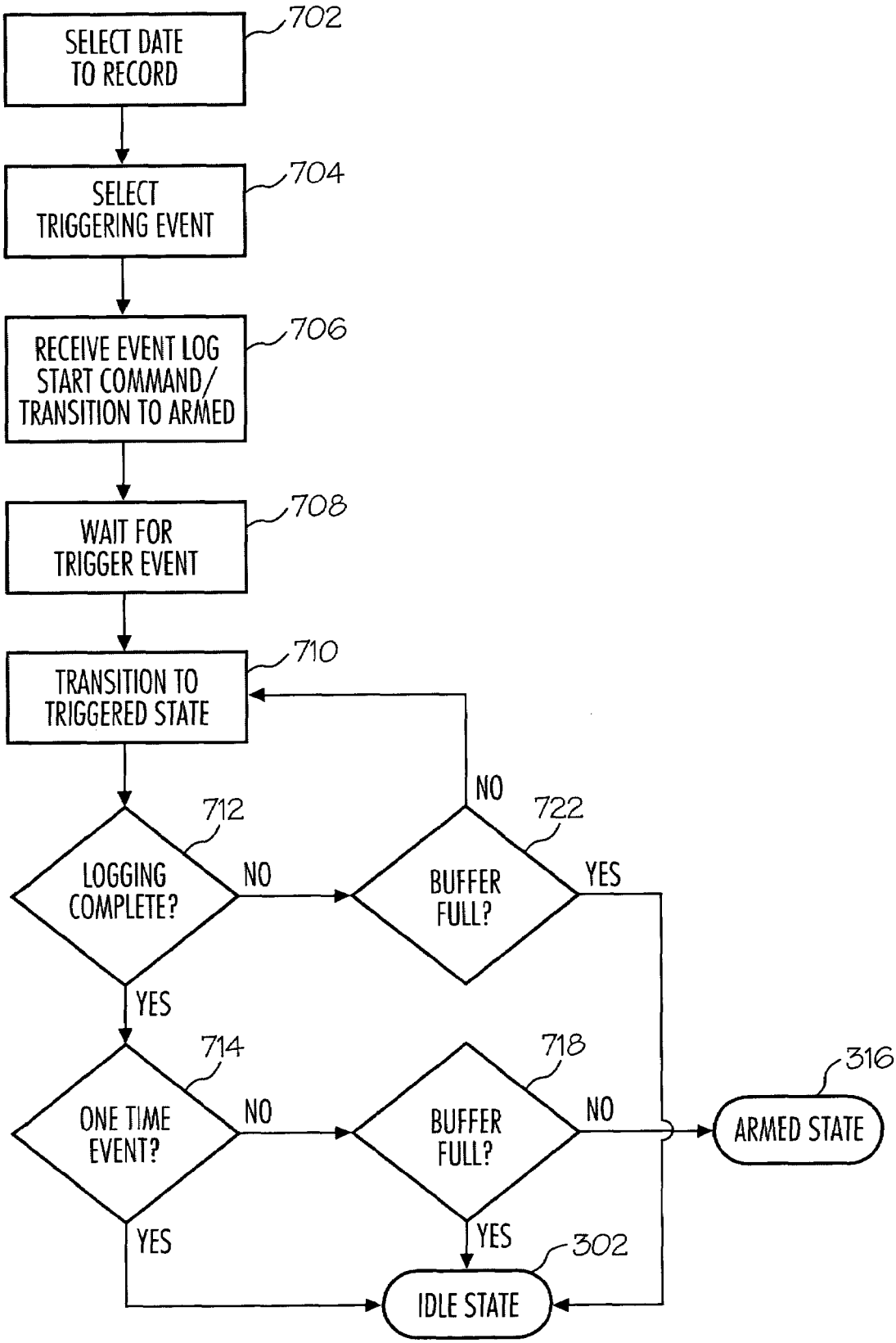
FIG. 7 is a flowchart illustrating the recording of data in a real time system in accordance with the teachings of the present invention.

In an exemplary embodiment, real time monitoring system 100 can be monitoring a system, such as the control moment gyros (CMGs) of an orbiting satellite. Because of the limited ability to send data and the impossibility of stopping the operation of the CMG to record data in the event of an anomalous condition, the present invention allows data to be captured in real time and the data to be sent at a later time. In operation, and with reference to FIG. 7, the data parameters to be monitored are set in step 702. As discussed previously, the data parameters to be monitored are set using the Event Log Data Select Command 305 when the Event Log Recorder 206 is in the Idle State 302 or Suspended State 404.

Next, in step 704, the triggering event can be defined using the Event Log Event Definition Command 303 when the Event Log Recorder 206 is in the Idle State 302 or Suspended State 404. As discussed previously, the Event Log Event Definition Command 303 sets one or more triggering events. For example, if the monitoring system is monitoring a CMG, the triggering event could be a rise in temperature or other anomalous event.

In step 706, the Event Log Recorder 206 receives the Event Log Start Command 307, which places the Event Log Recorder 206 in the Armed State 316. When the Event Log Recorder 206 is in the Armed State 316, the Event Log Recorder 206 waits for the occurrence of one or more of the events defined by the Event Log Event Definition Command 303 (step 708). As discussed previously, the Event Log Start Command 307 can set the Event Log Recorder 206 into one of two modes: (1) stop on event, or (2) start on event. When in the Stop on Event mode, the Event Log Recorder 206 records while in the Armed State 316, filing up the Event Log Buffer 104. When the Event Log Buffer 104 fills, the oldest data is eliminated first. When the triggering event occurs, the recording of data will then stop after a time specified in the Event Log Start Command 307.

When in the Start on Event mode, the Event Log Recorder 206 waits for a defined event to occur and then begins recording, using the defined delay times and record times as previously discussed. In one embodiment, the Event Log Recorder 206 continuously records data to the same record in the Event Log Buffer 104, overwriting the data in the record again and again while waiting for a triggering event to occur. When the triggering event occurs, the recording of data will start and continue filling subsequent records for a time and, in one embodiment, stop after a specified period of time. When in the Stop on Event mode, in one embodiment, when the Event Log Buffer 104 fills, the oldest data is eliminated first. When the triggering event occurs, the recording of data will start and continue for a time and, in one embodiment, stop after a specified period of time.

Upon detection of the triggering event, the Event Log Recorder 206 transitions to the Triggered State 406 (step 710). When recording data in the Triggered State 406, several things can occur. First, the Event Log Recorder 206 can check if the logging has been completed (step 712). If so, then, in step 714, the Event Log Recorder 206 can determine if the Event Log Event Definition Command 303 set a one time event or if multiple triggering events were defined. If the Event Log Event Definition Command 303 set only one event, the Event Log Recorder 206 transitions to the Idle State 302. If the defined event was not a one time event, in step 718 the Event Log Recorder 206 determines if the Event Log Buffer 104 is filled. If the Event Log Buffer 104 is full, the Event Log Recorder 206 transitions to the Idle State 302. If the Event Log Buffer 104 is not full, the Event Log Recorder 206 returns to the Armed State 316 to await further triggering events.

If, in step 712, it was determined that the logging was not complete, in step 722 the Event Log Recorder 206 can determine if the Event Log Buffer 104 is full. If the Event Log Buffer 104 is full, then the Event Log Recorder 206 transitions to the Idle State 302. If the Event Log Buffer 104 is not full, the Event Log Recorder 206 transitions to the Triggered State 406 and continues the recording of data.

The preceding illustrated how data is collected in an exemplary embodiment of the present invention. The present invention allows data regarding anomalous conditions to be recorded while the system being monitored is operating and saved in a buffer for later retrieval.

Figure 8:
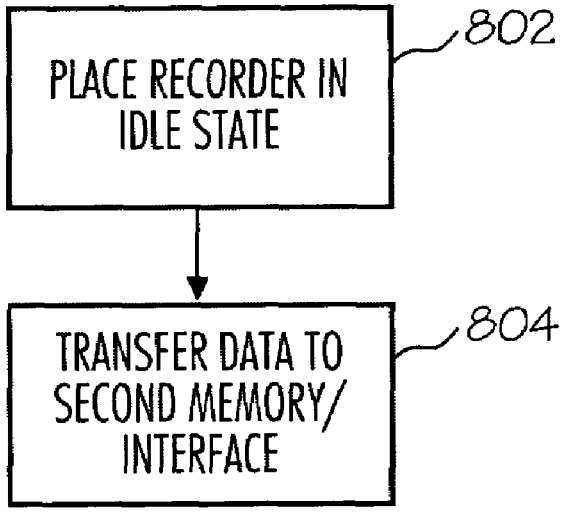
FIG. 8 is a flow chart illustrating the transference of data from an Event Log Buffer to a second memory or an interface in accordance with the teachings of the present invention.

FIG. 8 illustrates an exemplary embodiment of the retrieval of data in accordance with the teachings of the present invention. To retrieve data, the Event Log Recorder 206 can be placed in an Idle State 302 (step 804) or a Suspended State 404 followed by a transition to the Idle State 302. The Event Log Recorder 206 can transition to the Idle State 302 when the Event Log Buffer 104 is filled or if the event recording criteria is satisfied. The Event Log Recorder 206 can be placed in the Suspended State 404 when an Event Log Suspend Command 403 is received when the Event Log Recorder 206 is in the Armed State 316 or Triggered State 406.

Once in the Idle State 302 or in the Suspended State 404 the Event Log Recorder 206 can receive an Event Log Dump Command 309 (step 804). Upon reception of the Event Log Dump Command 309, data from the Event Log Buffer 104 is sent to the Recorder Status and Data Buffer 212. In one embodiment, all data can be sent at once to the Recorder Status and Data Buffer 212. In another embodiment, the data from the Event Log Buffer 104 is transferred a fixed amount at a time. This allows for data to be requested from the Recorder Status and Data Buffer 212 at a fixed rate for transference to another system, such as a transmitter for sending from a space vehicle to a terrestrial station. In one embodiment, Recorder Status and Data Buffer 212 is part of the dump memory 109. Alternatively, dump memory 109 can be an interface for future transfer to another device or computer.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A method for monitoring a system comprising:

monitoring the system in real time for a triggering event;

logging data about the system to a first memory upon detection of the triggering event and for a set time after the triggering event occurs;

continuing the monitoring of the system and the logging of data until the first memory is filled; and sending the data from the first memory to an interface for retrieval.

2. The method of claim 1 wherein the step of sending the stored data from the first memory to an interface for retrieval further comprises sending the data from the first memory to a second memory for retrieval.

3. The method of claim 1 further comprising the step of selecting parameters of the system to store as data upon occurrence of the triggering event prior to the step of monitoring the system for a triggering event.

4. The method of claim 1 further comprising the step of selecting one or more triggering events prior to the step of monitoring the system for a triggering event.

5. The method of claim 1 wherein the step of recording data about the system to a first memory for a set time when the triggering event occurs further comprising recording data about the system at an 8 HZ rate.

6. The method of claim 3 further comprising recording data concerning a first parameter at a first rate, and recording data concerning a second parameter at a second rate.

7. The method of claim 1 wherein the step of recording data about the system to a first memory further comprises recording data about the system to a circular buffer.

8. The method of claim 1 wherein the step of recording data about the system to a first memory for a set time when the triggering event occurs further comprises recording data about the system prior to the triggering event and for a period of time after the triggering event.

9. An event monitor for a system comprising:

one or more sensors operable to monitor one or more parameters of the system;

a first memory for storing the data the first memory configured to store data from a first parameter at a first data rate and store data from a second parameter at a second data rate different from the first data rate; and a processor, coupled to the one or more sensors, the processor operable to receive data from the one or more sensor and initiate storage of the received data in the first memory upon the occurrence of a predefined event, the processor further operable to continue the store data upon the occurrence of additional predefined events until the first memory is filled.

10. The monitor of claim 9 further comprising an interface operable to receive the data from the first memory at a selected time.

11. The monitor of claim 10 wherein the interface is a second memory.

12. The monitor of claim 11 wherein the selected time is upon a request sent to the processor for transfer of the data.

13. The monitor of claim 9 wherein the data comprises predetermined parameters of the system.

14. The monitor of claim 9 wherein the predefined events comprises one or more predefined events.

15. The monitor of claim 9 wherein the data is stored in the first memory at an 8 Hz rate.

16. The monitor of claim 9 wherein the first memory is a circular buffer memory.

17. The monitor of claim 9 wherein the processor is operable to initiate recording prior to the occurrence of the triggering event and further operable to allow continued recording for a set period of time after the occurrence of the triggering event.

18. The monitor of claim 9 wherein the system is a momentum control system of a spacecraft.

19. A momentum controls system for a spacecraft comprising:

an attitude control system configured to adjust the attitude of the spacecraft;

an attitude adjustment device; and a monitoring system coupled to the attitude control system, the monitoring system comprising:

one or more sensors operable to monitor one or more parameters of the attitude control system;

a processor, coupled to the one or more sensors, the processor operable to execute an event log recorder, the event log recorder configured to be placed in an armed state to monitor for a triggering event and a triggered state upon the detection of the triggering event detected by the one or more sensors; and an event log buffer coupled to the processor, the event log buffer configured to store data upon detection of the triggering event and for a set amount of time before the triggering event if the monitoring system is in a first setting and the event log buffer configured to store data upon detection of the triggering event and for a set amount of time after the triggering event if the monitoring system is in a second setting.

20. The system of claim 19 further comprising an interface operable to receive the data from the first memory at a selected time.

21. The system of claim 20 wherein the interface is a second memory.

22. The system of claim 21 wherein the selected time is upon a request at the processor for transfer of the data.

23. The system of claim 19 wherein the data comprises predetermined parameters of the system.

24. The system of claim 19 wherein the triggering event comprise one or more predefined events.

* * * * *